US008313044B2

(12) United States Patent
Stoops

(10) Patent No.: US 8,313,044 B2
(45) Date of Patent: Nov. 20, 2012

(54) SMOOTH BORE NOZZLE WITH ADJUSTABLE BORE

(75) Inventor: Kyle A. Stoops, Elkhart, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 0 days.

(21) Appl. No.: 13/191,129

(22) Filed: Jul. 26, 2011

(65) Prior Publication Data

US 2011/0278377 A1 Nov. 17, 2011

Related U.S. Application Data

(63) Continuation of application No. 12/332,695, filed on Dec. 11, 2008, now Pat. No. 8,006,923.

(60) Provisional application No. 61/013,112, filed on Dec. 12, 2007.

(51) Int. Cl.
*B05B 1/32* (2006.01)

(52) U.S. Cl. ..... 239/451; 169/88

(58) Field of Classification Search ..... 239/451, 239/452, 455, 458, 456, 437, 439, 546, DIG. 12, 239/533.13; 251/4, 5, 8; 169/88
See application file for complete search history.

(56) References Cited

U.S. PATENT DOCUMENTS

| | | | |
|---|---|---|---|
| 22,819 | A | 2/1859 | Parrott et al. |
| 186,310 | A | 1/1877 | Curtis |
| 351,968 | A | 11/1886 | Derrick |
| 583,135 | A | 5/1897 | Wilson |
| 690,754 | A | 1/1902 | McKechney |
| 851,603 | A | 4/1907 | Long |
| 930,095 | A | 8/1909 | Seagrave |
| 1,004,770 | A | 10/1911 | Galloway |
| 1,040,899 | A | 10/1912 | Dahmen |
| 1,072,951 | A | 9/1913 | Johnston |
| 1,865,012 | A | 6/1932 | Jackson |
| 2,303,992 | A | 12/1942 | Frazer et al. |
| 2,569,996 | A | 10/1951 | Kollsman |
| 2,585,509 | A | 2/1952 | Smith |
| 2,959,359 | A | 11/1960 | Casaletto |
| 3,018,792 | A | 1/1962 | Brucker |
| 3,301,492 | A | 1/1967 | Kingsley |

(Continued)

OTHER PUBLICATIONS

PCT International Search Report mailed Jul. 27, 2009 for corresponding PCT International Application No. PCT/US2008/086325.

*Primary Examiner* — Davis Hwu
(74) *Attorney, Agent, or Firm* — Faegre Baker Daniels

(57) ABSTRACT

A firefighting nozzle of the present invention includes a nozzle body with an inlet and an outlet, a passageway having a smooth bore extending between the inlet and the outlet of the nozzle body, and a compressible member defining at least a portion of the passageway. The compressible member has an inner dimension transverse to the longitudinal central axis. The nozzle also includes an adjuster mounted about the compressible member for selectively compressing the compressible member, wherein the pressure of the fluid flowing into the nozzle applies an outwardly directed pressure on the compressible member to thereby increase the inner dimension of the compressible member, and with at least a portion of the pressure being diverted from the passageway for applying an inwardly directed pressure on the compressible member to thereby at least reduce the force needed to be applied by the adjuster to counter-act the outwardly directed pressure when adjusting the flow rate of the nozzle.

20 Claims, 3 Drawing Sheets

U.S. PATENT DOCUMENTS

| | | | | |
|---|---|---|---|---|
| 3,684,192 | A | 8/1972 | McMillan | |
| 3,776,470 | A | 12/1973 | Tsuchiya | |
| 3,872,928 | A | 3/1975 | Livingston | |
| 4,095,747 | A | 6/1978 | Anderson | |
| 4,172,559 | A | 10/1979 | Allenbaugh, Jr. | |
| 5,215,254 | A | 6/1993 | Haruch | |
| 5,261,494 | A | 11/1993 | McLoughlin et al. | |
| 5,312,048 | A | 5/1994 | Steingass et al. | |
| 5,390,696 | A | 2/1995 | Bird et al. | |
| 5,590,719 | A | 1/1997 | McLoughlin et al. | |
| 5,964,410 | A | 10/1999 | Brown et al. | |
| 6,158,522 | A | 12/2000 | Laderoute | |
| 6,425,536 | B2 | 7/2002 | Namura | |
| 6,598,810 | B2 | 7/2003 | Lanteri | |
| 7,097,120 | B2 | 8/2006 | Marino | |
| 7,237,619 | B2 | 7/2007 | Mehr | |
| 7,258,285 | B1 | 8/2007 | Combs et al. | |
| 7,284,713 | B2 | 10/2007 | Geser et al. | |
| 8,006,923 | B2 * | 8/2011 | Stoops | 239/451 |
| 2007/0176022 | A1 | 8/2007 | Haiun | |
| 2007/0290063 | A1 | 12/2007 | Combs et al. | |

* cited by examiner

SMOOTH BORE NOZZLE WITH ADJUSTABLE BORE

CROSS REFERENCE TO RELATED APPLICATIONS

This application is a Continuation of U.S. patent application Ser. No. 12/332,695 filed Dec. 11, 2008, which claims the benefit of U.S. Provisional Patent Application Serial No. 61/013,112 filed Dec. 12, 2007, the entire disclosures of which are hereby expressly incorporated by reference herein.

TECHNICAL FIELD AND BACKGROUND OF THE INVENTION

The present invention generally relates to a nozzle and, more particularly, to a nozzle that has a smooth bore that is adjustable.

Smooth bore nozzles are well known in the art and are configured with a gradually diminishing inner diameter from their input end to their discharge or output end to increase fluid flow from a fire hose on which the nozzle is mounted. One disadvantage to smooth bore nozzles is that they typically have a fixed diameter. As a result, they provide a limited flow rate range, with the fluid pressure driving the flow rate change. For example, a one inch diameter smooth bore nozzle will flow approximately 184 gallons per minute at Approximately a 50 psi discharge pressure. However, if the fire hose discharge pressure is increased to 70 psi, the flow rate will increase to approximately 247 gallons per minute.

In order to change the flow rate from a fire hose, the smooth bore nozzle is either replaced with a smooth bore nozzle with a different diameter or a fitting or tip, which is typically threaded onto the nozzle, is added to or removed from the nozzle to change in the inner diameter of the nozzle. For example, when a one inch diameter smooth bore nozzle is substituted with a 1.25 inch diameter smooth bore nozzle, the flow will increase to approximately 326 gallons per minute with the same 50 psi discharge pressure. However, this requires the user to shut off the water supply when changing the nozzle or adding or removing a fitting to change the nozzle diameter. As a result, this can create downtime for the firefighter.

Accordingly, there is a need for a smooth bore nozzle whose flow rate can be adjusted without having to shut off the water flow.

SUMMARY OF THE INVENTION

Accordingly, the present invention provides a nozzle that has an adjustable bore and, therefore, can vary the flow rate through the nozzle without requiring the flow to be shut off. In other words, the present invention provides a nozzle that is adapted to have its bore diameter adjusted while still in a flow condition. The nozzle may be used in a handheld nozzle assembly, in a master stream nozzle, or in a pipe nozzle.

In one form of the invention, an adjustable nozzle includes a nozzle body and a passageway with a central axis and a smooth bore extending between the inlet and the outlet of the nozzle. The inlet is adapted for coupling to a fire suppressant source, such as a fire hose or a pipe. At least a portion of the passageway is defined by a compressible member with an inner dimension transverse to the central axis wherein the inner dimension of the compressible member is adjustable to adjust the flow rate through the nozzle. In addition, the nozzle includes an adjuster to selectively compress the compressible member. When fluid flows through the nozzle, the pressure of the fluid flowing into the nozzle applies an outwardly directed pressure on the compressible member to thereby increase the inner dimension of the compressible member. Further, the nozzle is configured to divert at least a portion of the fluid pressure for applying an inwardly directed pressure on the compressible member to thereby at least reduce the force needed to be applied to the adjuster to counteract the outwardly directed pressure acting on the compressible member when a user is trying to adjust the flow rate of the nozzle.

In one aspect, the nozzle further includes a flexible membrane interiorly of the compressible member, which forms a bladder and defines the passageway.

In another aspect, the compressible member includes a plurality of compressible members. For example, the compressible members may comprise cantilevered beams. In yet a further aspect, the inward pressure is applied to the distal end portions of the cantilevered beams.

According to yet another form of the invention, an adjustable nozzle includes a nozzle body having a longitudinal central axis and a compressible member, which is mounted to the nozzle body. The nozzle body and compressible member have therethrough a passageway, which forms an inlet and an outlet, with the inlet formed at the nozzle body for coupling to a fire suppressant source and the outlet formed at the end of the compressible body portion. The compressible member has an adjustable inner diameter, while the inner diameter of the nozzle body is fixed. In addition, the nozzle includes a tip that is movably mounted to the nozzle body about the compressible member and which is movable along the longitudinal axis and further includes an interface with the compressible member wherein the tip is movable to apply pressure on the compressible member to vary the inner diameter of the compressible member, which is urged outwardly by the fluid pressure of the fluid flowing through the nozzle. In addition, nozzle body includes at least one fluid passage in fluid communication with the fluid passageway through the nozzle body to redirect a portion of the fluid pressure exteriorly of the passageway and further is configured to apply an inward pressure on the compressible member to reduce the force needed to move the tip.

In one aspect, the nozzle may include a flexible membrane that forms a bladder interiorly of the compressible member and which defines a portion of the passageway. In a further aspect, the bladder has an inner diameter and an outer diameter, which is less than the inner diameter of the compressible member when in an unpressurized configuration and when the compressible member is uncompressed but expands to a pressurized configuration in response to fluid pressure in the passageway. When in the pressurized configuration, the bladder is compressible and able to maintain its smooth inner surface to provide the nozzle with an adjustable smooth bore.

In one aspect, the compressible member includes a plurality of spaced longitudinal slots extending along the central axis to form a plurality of beams. In a further aspect, the beams comprise cantilevered beams.

According to a further aspect, the tip comprises a conical-shaped body with a tapered interface with the compressible member. Further, the tapered surface is configured so that when the tip retracts onto the nozzle body, the tip compresses the compressible member.

Accordingly, the present invention provides a smooth bore nozzle with an adjustable diameter so that the flow rate through the nozzle can be achieved during a flow condition and further can be adjusted with greater ease.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
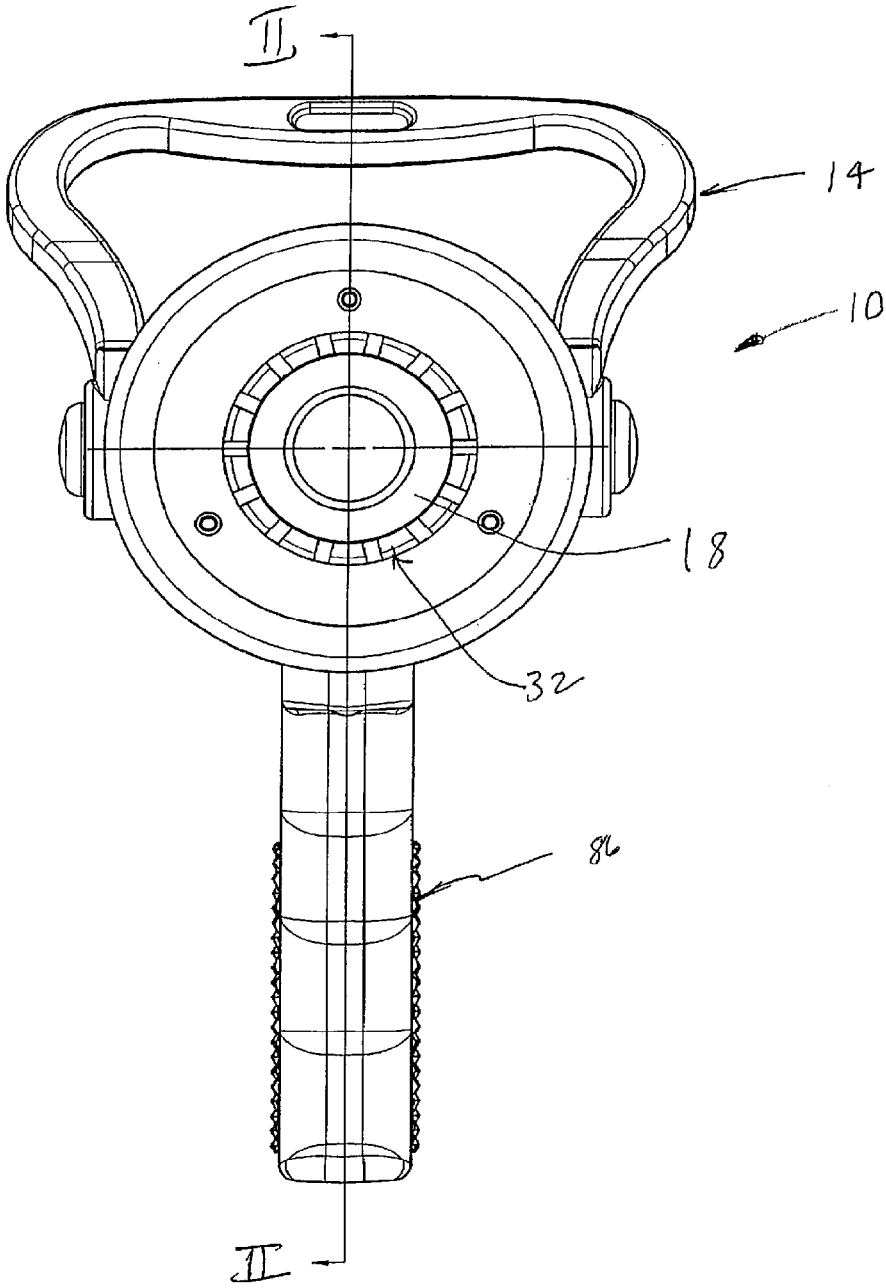
FIG. 1 is an end view of a nozzle of the present invention.

Referring to FIG. 1, the numeral 10 generally designates a nozzle assembly of the present invention. In the illustrated embodiment, nozzle assembly 10 comprises a handheld nozzle assembly, which is adapted for coupling to a fire hose and includes a nozzle 12 and a shut-off valve assembly 14 to open and close the flow of fluid through the nozzle assembly. As will be more fully described below, nozzle assembly 10 is configured to provide an adjustable smooth bore that can be adjusted while a fluid is still flowing through the nozzle assembly. Although illustrated in reference to a handheld nozzle assembly, it should be understood that the principals of this invention may be used in a master stream nozzle for mounting on a monitor or in a pipe nozzle.

Figure 2:
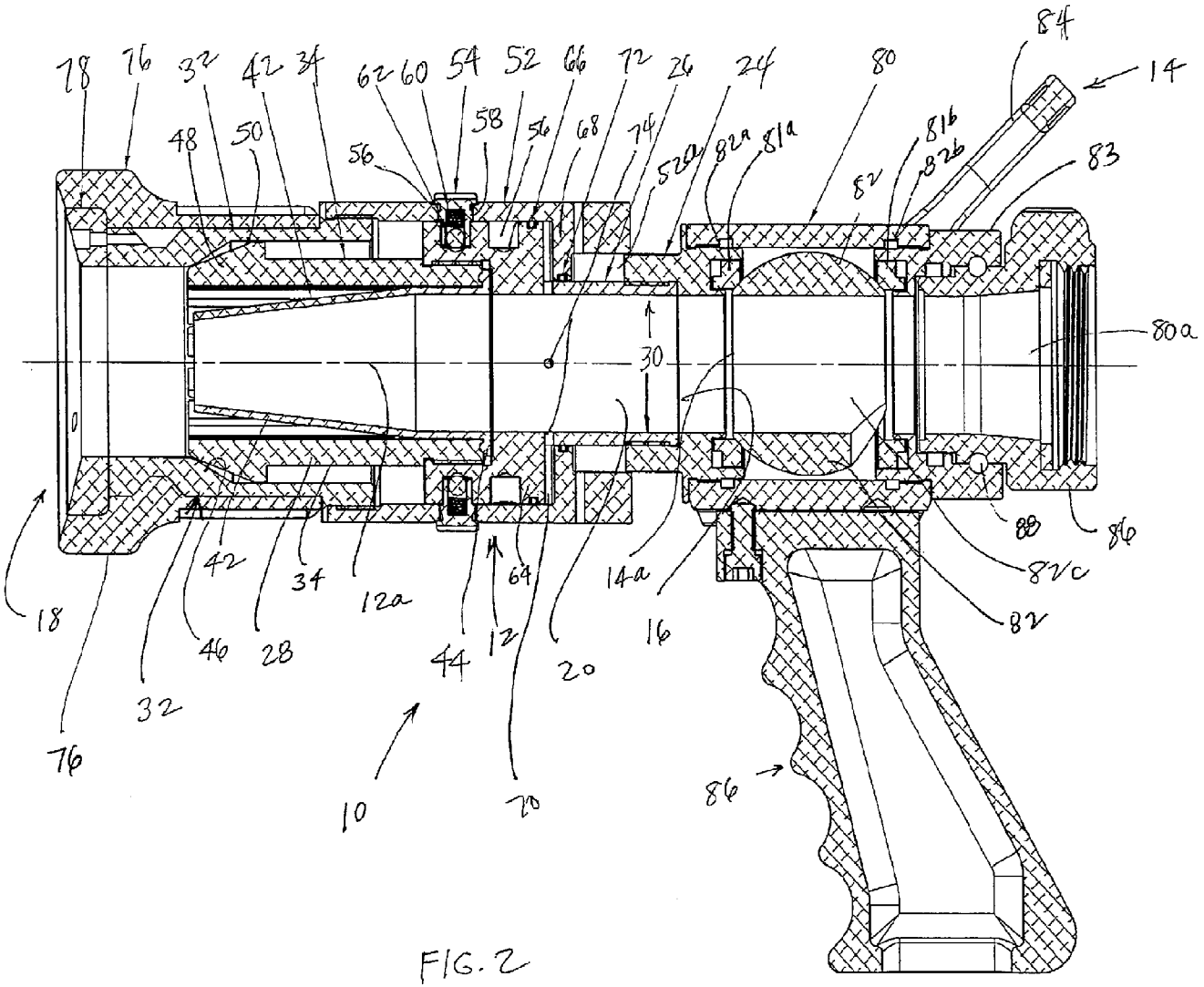
FIG. 2 is a cross-section view taken along line II-II of FIG. 1.

Referring to FIG. 2, nozzle 12 includes an inlet 16, an outlet 18, and a passageway 20 that extends from inlet 16 to outlet 18. Inlet 16 of nozzle 12 is in fluid communication with the outlet 14*a* of shut-off valve assembly 14 through an adapter 24 so that when the shut-off valve assembly is in its open position, fluid will flow through the shut-off valve assembly into nozzle 12 for discharge through outlet 18.

Figure 3:
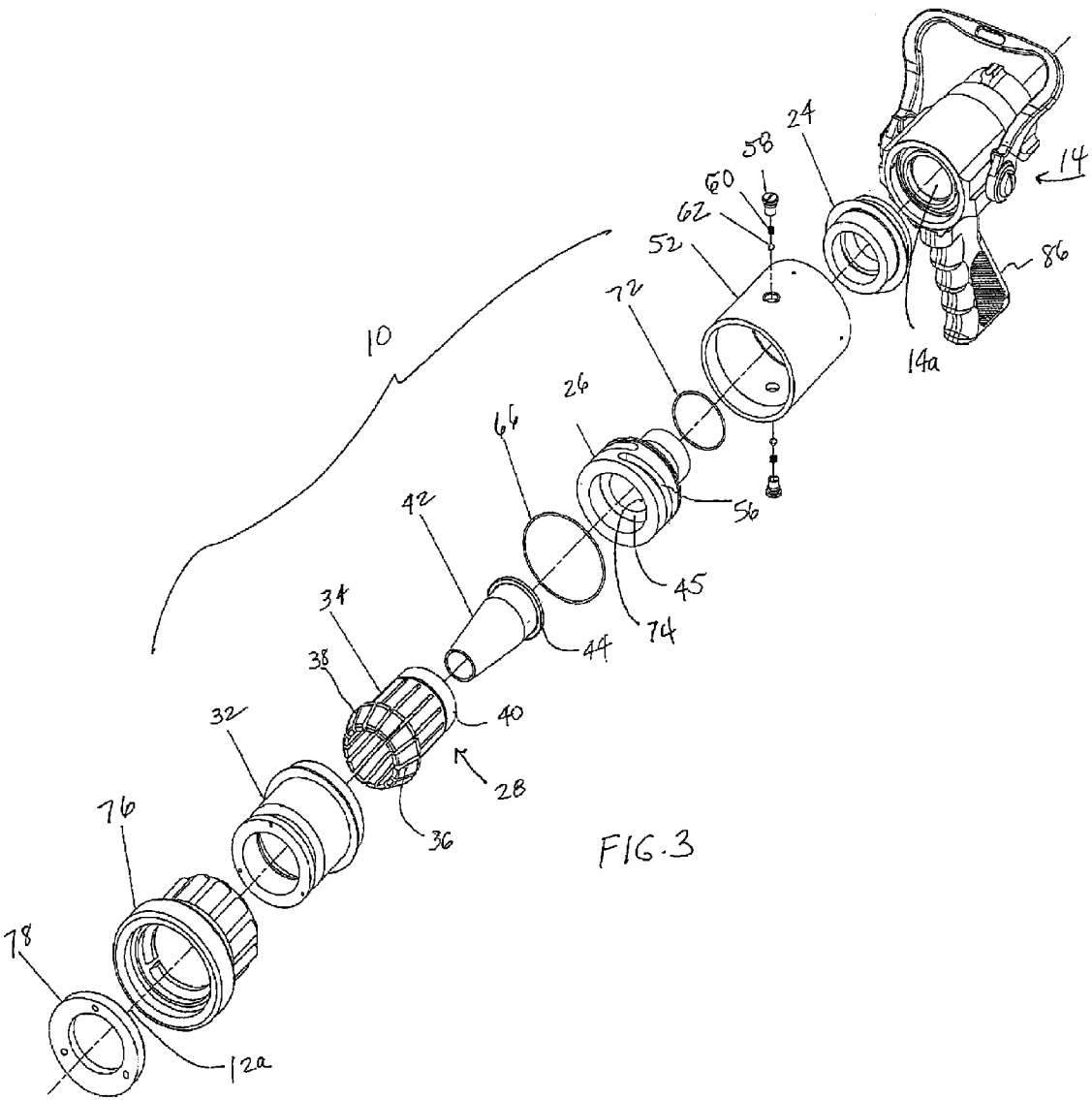
FIG. 3 is an exploded perspective view of the nozzle of the FIG. 1.

As best seen in FIG. 3, nozzle 12 includes a nozzle body 26 and a compressible wall 28, which is mounted to nozzle body 26 and extends from nozzle body 26 to allow adjustment to the flow of fluid through the nozzle. Nozzle body 26 comprises a cylindrical body with a fixed inner diameter 30. In the illustrated embodiment, compressible member 28 comprises a compressible wall that extends from nozzle body 26 along the longitudinal axis 12*a* of nozzle 12 and is configured to expand and contract relative to the longitudinal axis 12*a* in response to the pressure of fluid flowing through nozzle 12 and, further, in response to an external pressure applied by a tip 32, which is movably mounted to nozzle body 26. Furthermore, in the illustrated embodiment, compressible wall 34 includes a plurality of slots 36, which form cantilevered fingers or beams 38, which are cantilevered from a base 40, which secures compressible member to nozzle body. Preferably, slots 36 are aligned and generally parallel to the center line or central axis 12*a* of nozzle 12 and are formed, such as by molding or machining, so that they extend through the entire thickness of the cylindrical wall of cylindrical member 28 to thereby create cantilevered beams 38, which are flexible and act like springs that can be deflected inwardly to reduce the diameter of passageway 20 in the region of compressible member 28. Though described as separate components, it should be understood that compressible member and nozzle body may be formed as a unitary component.

To form a smooth bore through compressible member 28, nozzle 12 also optionally includes a membrane 42, which forms a bladder that extends through the compressible member. To secure membrane 42 to nozzle body, membrane 42 includes an annular rim or skirt, which is capture between an annular shoulder 45 formed on nozzle body 26 and compressible wall 34, which is threaded onto nozzle body 26 (FIG. 2). In this manner, the fluid passageway is formed through nozzle body 26 and membrane 42 with the portion of the passageway 20 formed in bladder 42 inwardly of compressible member 28 having an adjustable diameter.

In addition, to maintain a smooth bore in passageway 20, flexible membrane 42, such as a rubber flexible membrane, is sized such that its outer diameter is inward of the inner diameter of compressible member 28 when compressible member 28 is in an uncompressed condition. However, when membrane 42 is pressurized, membrane 42 will expand to an expanded configuration until the outer diameter is equal to the inner diameter of compressible member 28 when it reaches the inner surface of compressible member 28. In this manner, when compressible member 28 is compressed inwardly, membrane 42 will return to a less expanded configuration, which allows membrane 42 to maintain its smooth walled configuration and, hence, smooth bore and prevent membrane 42 from forming folds or ripples in its wall when compressed. Optionally, a metal sleeve may be positioned between membrane 42 and beams 38 to assure that the membrane 42 does not extrude into the gaps between the beams. For further details of membrane 42 and an optional metal sleeve, reference is made to U.S. Pat. No. 7,258,285, issued Aug. 21, 2007, entitled ADJUSTABLE SMOOTH BORE NOZZLE, and copending application Ser. No. 11/894,089, filed Aug. 20, 2007, entitled ADJUSTABLE SMOOTH BORE NOZZLE, which are incorporated by reference in their entireties herein.

As noted above, compressible member 28 is compressed by the movement of tip 32 relative to longitudinal axis 12*a* of nozzle 12. Tip 32 comprises a generally cylindrical member with a tapered wall, which forms an angled interface surface 46 for compressing compressible member 28. Angled surface 46 contacts the outer ends of compressible member 28 and forms a ramped or cam interface with compressible member 28. In the illustrated embodiment, each beam 38 of compressible member 28 includes a ramped surface 50, which is formed by example by a wedge-shaped end that provides a contact surface for angled surface 46 of tip 32. In this manner, when adjustment tip 32 is retracted along nozzle body 26, angled surface 46 will move along ramp surfaces 50, which will cause beams 38 to compress inwardly when adjustment tip 32 is retracted onto nozzle body 26 but will allow beams 38 to expand radially outward and return to their uncompressed state when adjustment tip 32 is moved to its fully extended position such as shown in FIG. 2. It should be understood that the slope angle of the ramps surfaces and angled surfaces may be varied to increase or decrease the amount of adjustment achieved by a given linear movement of the tip along the nozzle.

In the illustrated embodiment, tip 32 is mounted to nozzle body 26 by an annular member 52, which extends into annular member 52 and is threaded to the inner surface of annular member 52. Annular member 52 is secured to nozzle body by a pair of cam/detent screws 54, which extend through annular member 52 and into a cam groove or slot 56 formed on outer surface of nozzle body 26 (FIG. 3). Each cam/detent screw 54 includes a threaded hollow pin 58, which receives a spring 60, and ball bearing 62 which is urged by spring 60 into engagement with cam slot 56. In this manner, annular member 52 is rotatably mounted about nozzle body 26 while being laterally retained on nozzle body 26 along longitudinal axis 12*a*. Thus, when tip 32 is rotated about longitudinal axis 12*a*, annular member 52 will retract or extend tip 32 along axis 12*a*, which will either compress member 28, and reduce the inner diameter of passageway 20, or will allow compressible member 28 to expand under the force of the fluid flowing through nozzle 12. However, it should be understood that annular member 52 may be secured to the nozzle body with a threaded connection so that annular member 52 is guided along the threads of the threaded connection. Further, annular member 52 may be moved along the nozzle body by an actuator, such as an electric actuator, thus potentially eliminating the need for a cam groove, a slot, or the threaded connection.

Referring again to FIG. 3, cam slot 56 is formed on an enlarged shoulder 64 of nozzle body 26, which is sealed against the inner surface of annular member 52 by a seal 66, such as an o-ring seal (FIG. 2). Further, annular member 52 includes an inwardly extending radial wall 68 to thereby enclose enlarged flange portion 64 of nozzle body 26 and, further, to define a chamber 70 between nozzle body 26 and annular member 52, which will be more fully described below.

In order to reduce the amount of force required to compress compressible wall 28, a portion of the fluid pressure in passageway 20 is redirected exteriorly of passageway 20 and, further, is used to apply an inwardly directed compression force on compressible member 28. In the illustrated embodiment, nozzle body 26 includes one or more fluid passages 74, which are in fluid communication with passageway 20 and, further, in fluid communication with chamber 70. To seal chamber 70, a seal 72, such as an o-ring seal, is positioned between inwardly extending radial wall 68 and nozzle body 26. Thus, when fluid pressure is redirected into chamber 70, the pressure in chamber 70 will apply an axial force on inwardly extending radial wall 68 of annular member 52, which will urge annular member 52 to move to the right as viewed in FIG. 2 and thereby act as a piston. To accommodate the longitudinal movement of annular member 52 relative to the longitudinal axis 12*a* of nozzle 12, annular member 52 includes a recessed annular portion 52*a*, which is sized to receive adapter 24 therein.

As the pressure inside passageway 20 increases, the pressure on annular member 52 will increase. Thus, when an operator wishes to throttle the outlet 18 of nozzle 12, the force required to rotate tip 32 about nozzle body 26 will be reduced by the force due to pressure applied to inwardly extending radial wall 68. Thus, by redirecting a portion of the fluid pressure externally of passage 20, a mechanical advantage is provided to facilitate throttling of the nozzle. In another application, the annular member may be configured to release pressure on the inwardly extending radial wall to increase the diameter of the base.

In the illustrated embodiment, fluid passages 74 comprise circular transverse openings, but it should be understood that passages 74 may also comprise slotted openings or the like. Further, it should be understood that the number and size of the passages may be varied depending, for example, on the size of the nozzle and nozzle bore, and further the desired mechanical advantage.

Optionally, mounted about tip 32 is a bumper 76, such as a rubber bumper, which is secured to tip 32 by a retaining ring 78 and by a plurality of fasteners that extend through retaining ring 78 and into corresponding threaded openings provided in tip 32. Bumper 76 provides a gripping surface for tip and is optionally formed from an elastomeric material, such as rubber, to protect the tip.

As noted above, nozzle 12 is mounted to an on/off valve assembly 14 to control the flow of fluid into the nozzle. As best seen in FIG. 2, shut-off valve assembly 14 includes a valve body 80, which is threaded to adapter 24 and to an inlet adapter 83. Rotatably mounted in adapter 83 is an inlet coupler 86 for securing a hose to shut-off valve assembly 14. In addition, assembly 14 includes a pair of spaced apart valve seats 81*a* and 81*b* mounted in adapters 24 and 83, respectively, and a shut-off ball 82, which is positioned between seats 81*a* and 81*b*. Ball 82 is pivotally mounted in valve body 80 on a shaft (not shown) that is coupled to a handle 84. In this manner, the orientation of shut-off ball 82 may be adjusted by moving handle 84. To seal adapters in valve body 80, seals, such as o-ring seals 82*a* and 82*b*, are positioned between adapters 24 and 83 and valve body 80. Seals are also provided between seats 81*a* and 81*b* and the respective adapters 24 and 83, as well as between coupler 86 and adapter 83. Further, coupler 86 includes a ball race 88, which provides a swivel mount for coupler 86 to adapter 83.

Valve seats 81*a* and 81*b* are respectively positioned adjacent adapters 24 and 83 so that when central passage 82*c* of shut-off ball 82 is aligned between the seats (81*a*, 81*b*), nozzle assembly 10 is opened for flow through the nozzle 12, but when shut-off ball 82 is pivoted by handle 84, shut-off ball 88 will seat against seat 81*a* and close passage 80*a* and, thereby stop the flow into passageway 20.

Further, assembly 10 may also include a handle 86, mounted to shut-off valve assembly 14 to facilitate handling of assembly 10.

As would be understood to those skilled in the art, the present invention provides a nozzle that has a smooth bore with an adjustable inner diameter to provide an adjustable flow rate. With this increase in flexibility, the velocity of a fire hose discharge may be varied without having to replace the nozzle or having to add on to the nozzle; therefore, the adjustment can be achieved while the nozzle is still in a flowing condition and, further, with greater ease.

While several forms of the invention have been shown and described, other forms will now be apparent to those skilled in the art. For example, as noted, nozzle 12 may be incorporated into a pipe nozzle or a master stream nozzle of a monitor. Further, while described in reference to a segmented compressible member, the compressible member may comprise a solid wall with overlapping edges, which allow the wall to compress. In addition, though described in reference to a nozzle that incorporates a bladder, the bladder may be eliminated. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A method for operating a firefighting nozzle comprising a nozzle body with an inlet and an outlet, a fluid passageway defining a flow path extending between the inlet and the outlet, the outlet defining an outlet cross-sectional area, and an adjuster mounted onto the nozzle body, the adjuster adjustable from a first position to a second position by application of an adjustment force, such that the outlet cross-sectional area is limited by the adjuster to a smaller cross-sectional area in the second position as compared to the first position, the method comprising the steps of:

directing a flow of pressurized fluid through the fluid passageway; and redirecting a portion of the pressurized fluid from the flow path of the fluid passageway, the redirected fluid applying a fluid force on the adjuster which urges the adjuster toward the second position, such that the adjustment force required to adjust the adjuster from the first position to the second position is reduced by application of the fluid force.

2. The method of claim 1 wherein the firefighting nozzle further comprises a compressible member defining the outlet cross-sectional area, the method further comprising:

adjusting the adjuster from the first position to the second position to apply a radially inward compressive force on the compressible member, such that said step of adjusting limits the outlet cross-sectional area.

3. The method of claim 2, wherein the adjuster is mounted onto the nozzle body about the compressible member to define an annular fluid chamber between the adjuster and the compressible member, said step of redirecting comprising redirecting the pressurized fluid into the annular fluid chamber, the pressurized fluid in the annular fluid chamber urging the adjuster into engagement with the compressible member.

4. The method of claim 2, wherein said step of adjusting comprises rotating the adjuster about the nozzle body, said step of rotating causing translation of the adjuster along one of an upstream direction and a downstream direction.

5. The method of claim 4 wherein the compressible member has a plurality of fingers including angled interface surfaces facing radially outwardly, and the adjuster has a ramped surface forming a cam interface with the angled interface surfaces of the compressible member, said step of rotating the adjuster engaging the cam interface to change the outlet cross-sectional area.

6. The method of claim 2 wherein said step of adjusting comprises axially translating the adjuster along an upstream direction to exert a radial inward force on the compressible member, thereby compressing the compressible member.

7. The method of claim 2 wherein the compressible member comprises a plurality of compressible fingers.

8. The method of claim 2 wherein said step of directing a flow of pressurized fluid through the fluid passageway comprises exerting a radial outward force on the compressible member, said step of redirecting a portion of the pressurized fluid applying the fluid force to the adjuster to urge the adjuster to apply a compressive force on the compressible member radially inwardly, such that the fluid force at least partially counter-acts the radial outward force on the compressible member.

9. A method for operating a firefighting nozzle comprising a nozzle body with an inlet and an outlet, the outlet defining an outlet cross-sectional area, a fluid passageway defining a flow path extending between the inlet and the outlet; a compressible member disposed in said nozzle body proximate the outlet; and an adjuster mounted onto the nozzle body, the adjuster adjustable from a first position to a second position by application of an adjustment force, the compressible member compressed radially inwardly to limit the outlet cross-sectional area to a smaller cross-sectional area when the adjuster is in the second position as compared to the first position, the method comprising the steps of:

directing a flow of pressurized fluid through the fluid passageway and outwardly from the nozzle body via the outlet, a portion of the pressurized fluid exerting a radial outward force on the compressible member;

redirecting a portion of the pressurized fluid from the flow path of the fluid passageway, the redirected fluid applying a fluid force on the adjuster which urges the adjuster toward the second position, such that the adjustment force required to adjust the adjuster from the first position to the second position is reduced by application of the fluid force.

10. The method of claim 9, wherein the adjuster is mounted onto the nozzle body about the compressible member to define an annular fluid chamber between the adjuster and the compressible member, said step of redirecting comprising redirecting the pressurized fluid into the annular fluid chamber, the pressurized fluid in the annular fluid chamber urging the adjuster into engagement with the compressible member.

11. The method of claim 10, wherein the pressurized fluid and the redirected fluid each define a common fluid pressure, such that the fluid force urging the compressible member radially inwardly via the adjuster increases with increasing fluid pressure, thereby counter-acting a concomitant increase in the radial outward force exerted on the compressible member by the pressurized fluid.

12. The method of claim 9, further comprising the step of adjusting the adjuster by rotating the adjuster about the nozzle body, said step of rotating causing translation of the adjuster along one of an upstream direction and a downstream direction.

13. The method of claim 9 wherein the compressible member has a plurality of fingers including angled interface surfaces facing radially outwardly, and the adjuster has a ramped surface forming a cam interface with the angled interface surfaces of the compressible member, said step of redirecting urging the adjuster into engagement with the compressible member at the cam interface, such that the fluid force urges the adjuster to compress the compressible member radially inwardly.

14. The method of claim 9 wherein said step of adjusting comprises axially translating the adjuster along an upstream direction to exert a radial inward force on the compressible member.

15. The method of claim 9 wherein the compressible member comprises a plurality of compressible fingers spaced apart from another.

16. The method of claim 15 wherein the fluid force exerted by said step of redirecting exerts a radial inward force on each of the plurality of compressible fingers via the adjuster.

17. A method for operating a firefighting nozzle comprising a nozzle body with an inlet and an outlet, the outlet defining an outlet cross-sectional area, a fluid passageway defining a flow path extending between the inlet and the outlet; a compressible member disposed in said nozzle body proximate the outlet, the compressible member having a plurality of fingers including angled interface surfaces facing radially outwardly; and an adjuster mounted onto the nozzle body about the compressible member, the adjuster having a ramped surface forming a cam interface with the angled interface surfaces of the compressible member, the ramped surface adjustable from a downstream position to an upstream position by application of an adjustment force, the method comprising the steps of:

directing a flow of pressurized fluid through the fluid passageway and outwardly from the nozzle body via the outlet, a portion of the pressurized fluid exerting a radial outward force on the compressible member;

redirecting a portion of the pressurized fluid from the flow path of the fluid passageway, the redirected fluid applying a fluid force on the adjuster which urges the adjuster toward the upstream position, such that the adjustment force required to compress the compressible member radially inwardly is reduced by application of the fluid force; and with the aid of the fluid force, exerting the adjustment force on the adjuster to move the adjuster toward the upstream position, such that the cam interface compresses the plurality of fingers of the compressible member radially inwardly to limit the outlet cross-sectional area.

18. The method of claim 17, wherein the adjuster is mounted onto the nozzle body about the compressible member to define an annular fluid chamber between the adjuster and the compressible member, said step of redirecting comprising redirecting the pressurized fluid into the annular fluid chamber, the pressurized fluid in the annular fluid chamber urging the adjuster into engagement with the compressible member.

19. The method of claim 17, wherein the pressurized fluid and the redirected fluid each define a common fluid pressure, such that the fluid force urging the compressible member radially inwardly via the adjuster increases with increasing fluid pressure, thereby counter-acting a concomitant increase in the radial outward force exerted on the compressible member by the pressurized fluid.

20. The method of claim 17, wherein said step of exerting the adjustment force on the adjuster comprises rotating the adjuster about the nozzle body, said step of rotating causing translation of the adjuster along an upstream direction.

* * * * *